US009665022B2

(12) United States Patent
Araki et al.

(10) Patent No.: US 9,665,022 B2
(45) Date of Patent: May 30, 2017

(54) METHOD OF PRODUCING ELECTROPHOTOGRAPHIC TONER, ELECTROPHOTOGRAPHIC TONER, TONER CARTRIDGE, AND IMAGE FORMING APPARATUS

(71) Applicants: KABUSHIKI KAISHA TOSHIBA, Minato, Tokyo (JP); TOSHIBA TEC KABUSHIKI KAISHA, Shinagawa, Tokyo (JP)

(72) Inventors: Satoshi Araki, Shizuoka (JP); Maiko Yoshida, Shizuoka (JP); Taishi Takano, Shizuoka (JP); Takashi Urabe, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 14/309,630

(22) Filed: Jun. 19, 2014

(65) Prior Publication Data

US 2015/0370184 A1 Dec. 24, 2015

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0804* (2013.01); *G03G 9/08782* (2013.01); *G03G 9/0926* (2013.01); *G03G 9/09307* (2013.01); *G03G 9/09335* (2013.01); *G03G 9/09392* (2013.01)

(58) Field of Classification Search

CPC ..... G03G 9/09335; G03G 9/09307; G03G 9/09392; G03G 9/09385; G03G 9/0926; G03G 9/0902; G03G 9/0804

USPC ..... 430/137.14

See application file for complete search history.

(56) References Cited

U.S. PATENT DOCUMENTS

2009/0258251 A1* 10/2009 Abe ..... A61K 8/26 428/702

FOREIGN PATENT DOCUMENTS

| | | | |
|---|---|---|---|
| JP | 2010-256613 | | 11/2010 |
| JP | 2013-072944 A | * | 4/2013 |
| JP | 2013-200521 A | * | 10/2013 |

OTHER PUBLICATIONS

ESPACENET machine-assisted English-language translation of JP 2013-072944 A (pub. on Apr. 22, 2013).*

ESPACENET machine-assisted English-language translation of JP 2013-200521 A (pub. on Oct. 3, 2013).*

* cited by examiner

*Primary Examiner* — Janis L Dote

(74) *Attorney, Agent, or Firm* — Patterson & Sheridan, LLP

(57) ABSTRACT

A method of producing an electrophotographic toner is disclosed in an embodiment. A colorant dispersion liquid that contains colorant particles having an average particle diameter of 6 μm or greater is formed. A resin dispersion liquid that contains resin particles is formed. A wax dispersion liquid that contains wax particles is formed. In a first aggregation, the resin dispersion liquid and the wax dispersion liquid are added to the colorant dispersion liquid.

8 Claims, 4 Drawing Sheets

FIG. 4

| | PREPARATION METHOD | COLORANT | COMPOSITION OF TONER | | | | |
|---|---|---|---|---|---|---|---|
| | | | COLORANT (PART BY MASS) | RESIN (PART BY MASS) | WAX (PART BY MASS) | HYDROPHOBIC SILICA (PART BY MASS) | TITANIUM OXIDE (PART BY MASS) |
| EXAMPLE 1 | AGGREGATION METHOD | CYAN PIGMENT | 34 | 57 | 9 | 2 | 0.5 |
| EXAMPLE 2 | AGGREGATION METHOD | CYAN PIGMENT | 49 | 37 | 14 | 2 | 0.5 |
| EXAMPLE 3 | AGGREGATION METHOD | Iriodin153 | 46 | 40 | 14 | 2 | 0.5 |
| EXAMPLE 4 | AGGREGATION METHOD | Iriodin120 | 14 | 69 | 17 | 2 | 0.5 |
| EXAMPLE 5 | AGGREGATION METHOD | Iriodin111 | 33 | 50 | 17 | 2 | 0.5 |
| EXAMPLE 6 | AGGREGATION METHOD | Iriodin323 | 49 | 37 | 14 | 2 | 0.5 |
| EXAMPLE 7 | AGGREGATION METHOD | CYAN PIGMENT | 25 | 69 | 6 | 2 | 0.5 |
| EXAMPLE 8 | AGGREGATION METHOD | Iriodin120 | 24 | 71 | 5 | 2 | 0.5 |
| EXAMPLE 9 | AGGREGATION METHOD | CYAN PIGMENT | 31 | 57 | 12 | 2 | 0.5 |
| EXAMPLE 10 | AGGREGATION METHOD | CYAN PIGMENT | 26 | 49 | 25 | 2 | 0.5 |
| EXAMPLE 11 | AGGREGATION METHOD | Iriodin153 | 58 | 32 | 10 | 2 | 0.5 |
| EXAMPLE 12 | AGGREGATION METHOD | CYAN PIGMENT | 49 | 37 | 14 | 2 | 0.5 |
| EXAMPLE 13 | AGGREGATION METHOD | Iriodin153 | 49 | 37 | 14 | 2 | 0.5 |
| COMPARATIVE EXAMPLE 1 | AGGREGATION METHOD | CYAN PIGMENT | 49 | 37 | 14 | 2 | 0.5 |
| COMPARATIVE EXAMPLE 2 | AGGREGATION METHOD | CYAN PIGMENT | 49 | 37 | 14 | 2 | 0.5 |
| COMPARATIVE EXAMPLE 3 | GRINDING METHOD | Iriodin120 | 30 | 60 | 10 | 2 | 0.5 |

FIG. 5

| | FIRST AGGREGATION STEP | SECOND AGGREGATION STEP | VOLUME AVERAGE PARTICLE SIZE OF COLORANT PARTICLES (μm) | AMOUNT OF RESIN ADDED BASED ON 100 PARTS BY MASS OF AMOUNT OF WAX ADDED (PART BY MASS) | AMOUNT OF WAX ADDED BASED ON TOTAL AMOUNT OF WAX TO BE ADDED (% BY MASS) | AVERAGE PARTICLE DIAMETER OF TONER (μm) | EVALUATION | | | |
|---|---|---|---|---|---|---|---|---|---|---|
| | | | | | | | DECO-RATIVE-NESS | OFFSET PROPERTIES | FOG-GING | FILMING |
| EXAMPLE 1 | PERFORMED | PERFORMED | 95 | 93 | 100 | 115 | A | B | A | A |
| EXAMPLE 2 | PERFORMED | PERFORMED | 95 | 15 | 100 | 103 | A | A | A | A |
| EXAMPLE 3 | PERFORMED | PERFORMED | 51 | 4. 6 | 100 | 71 | A | B | B | B |
| EXAMPLE 4 | PERFORMED | PERFORMED | 14 | 409 | 91 | 31 | B | A | B | B |
| EXAMPLE 5 | PERFORMED | PERFORMED | 9 | 284 | 93 | 13 | B | A | B | B |
| EXAMPLE 6 | PERFORMED | NOT PERFORMED | 15 | 15 | 100 | 18 | B | B | A | A |
| EXAMPLE 7 | PERFORMED | PERFORMED | 95 | 93 | 100 | 143 | B | B | A | A |
| EXAMPLE 8 | PERFORMED | PERFORMED | 14 | 1388 | 67 | 25 | B | A | B | B |
| EXAMPLE 9 | PERFORMED | PERFORMED | 95 | 2 | 100 | 122 | B | B | B | B |
| EXAMPLE 10 | PERFORMED | PERFORMED | 95 | 196 | 87 | 160 | B | A | C | C |
| EXAMPLE 11 | PERFORMED | NOT PERFORMED | 51 | 80 | 0 | 83 | A | B | C | C |
| EXAMPLE 12 | PERFORMED | PERFORMED | 6 | 15 | 100 | 9 | B | C | A | A |
| EXAMPLE 13 | PERFORMED | PERFORMED | 51 | 15 | 100 | 80 | B | C | A | A |
| COMPARATIVE EXAMPLE 1 | NOT PERFORMED (SIMULTANEOUS ADDITION) | – | 95 | 100 | 100 | 120 | C | B | D | D |
| COMPARATIVE EXAMPLE 2 | PERFORMED | PERFORMED | 4 | 93 | 100 | 7 | D | A | A | A |
| COMPARATIVE EXAMPLE 3 | NOT PERFORMED (BATCH KNEADING) | – | 14 | – | – | 15 | D | E | D | D |

METHOD OF PRODUCING ELECTROPHOTOGRAPHIC TONER, ELECTROPHOTOGRAPHIC TONER, TONER CARTRIDGE, AND IMAGE FORMING APPARATUS

FIELD

Embodiments described herein relate generally to an electrophotographic toner, a toner cartridge, an image forming apparatus, and a method of producing an electrophotographic toner.

BACKGROUND

In recent years, among customers, the demand for high-value printing has increased. Particularly, the demand for obtaining printed matter (i.e., a decorative image) having glossiness is high.

It is known that if an electrophotographic toner (hereinafter, simply referred to as "toner" in some cases) which contains a pigment having a large particle diameter as a colorant is used, the printed matter having unique luster is obtained. However, when the toner is produced by a grinding method by using the pigment having a large particle diameter, fogging or the like may occur in some cases. This is because the toner contains a large number of particles of the pigment alone, particles having a large area where the pigment is exposed, or particles not containing the pigment.

However, if an attempt is made to produce a toner containing a small number of particles of a pigment alone or a toner containing a large number of particles having a small area where the pigment is exposed, the particle diameter of the toner increases. As a result, orientation of the pigment on a substrate becomes insufficient, and thereby desired high image quality is not obtained in some cases.

If a pigment having a large particle diameter is used as a colorant, the pigment particles themselves are likely to hinder the bleed-out of wax when the toner was melted. Consequently, during the formation of an image, release properties are not exhibited, and offset may occur in some cases.

DESCRIPTION OF THE DRAWINGS

FIG. 4 illustrates example compositions of a toner according to an embodiment.

FIG. 5 illustrates example evaluation results of the toner compositions, according to the embodiment of FIG. 4.

DETAILED DESCRIPTION

Exemplary embodiments are to provide an electrophotographic toner which may exhibit sufficient image quality and does not easily cause fogging or offset, a method of producing the toner, a toner cartridge, and an image forming apparatus.

A method of producing an electrophotographic toner is disclosed in an embodiment. A colorant dispersion liquid that contains colorant particles having an average particle diameter of 6 μm or greater is formed. A resin dispersion liquid that contains resin particles is formed. A wax dispersion liquid that contains wax particles is formed. In a first aggregation, the resin dispersion liquid and the wax dispersion liquid are added to the colorant dispersion liquid.

The average particle diameter means the volume average particle diameter which refers to the particle diameter of a particle, the value of which is arrived at when the cumulative volume distribution of the particles reaches 50% determined from the sum of the volumes of the individual particles calculated from the particle diameters.

Hereinafter, the method of producing an electrophotographic toner according to the present embodiment will be descried with reference to the drawings.

First Embodiment

Figure 1:
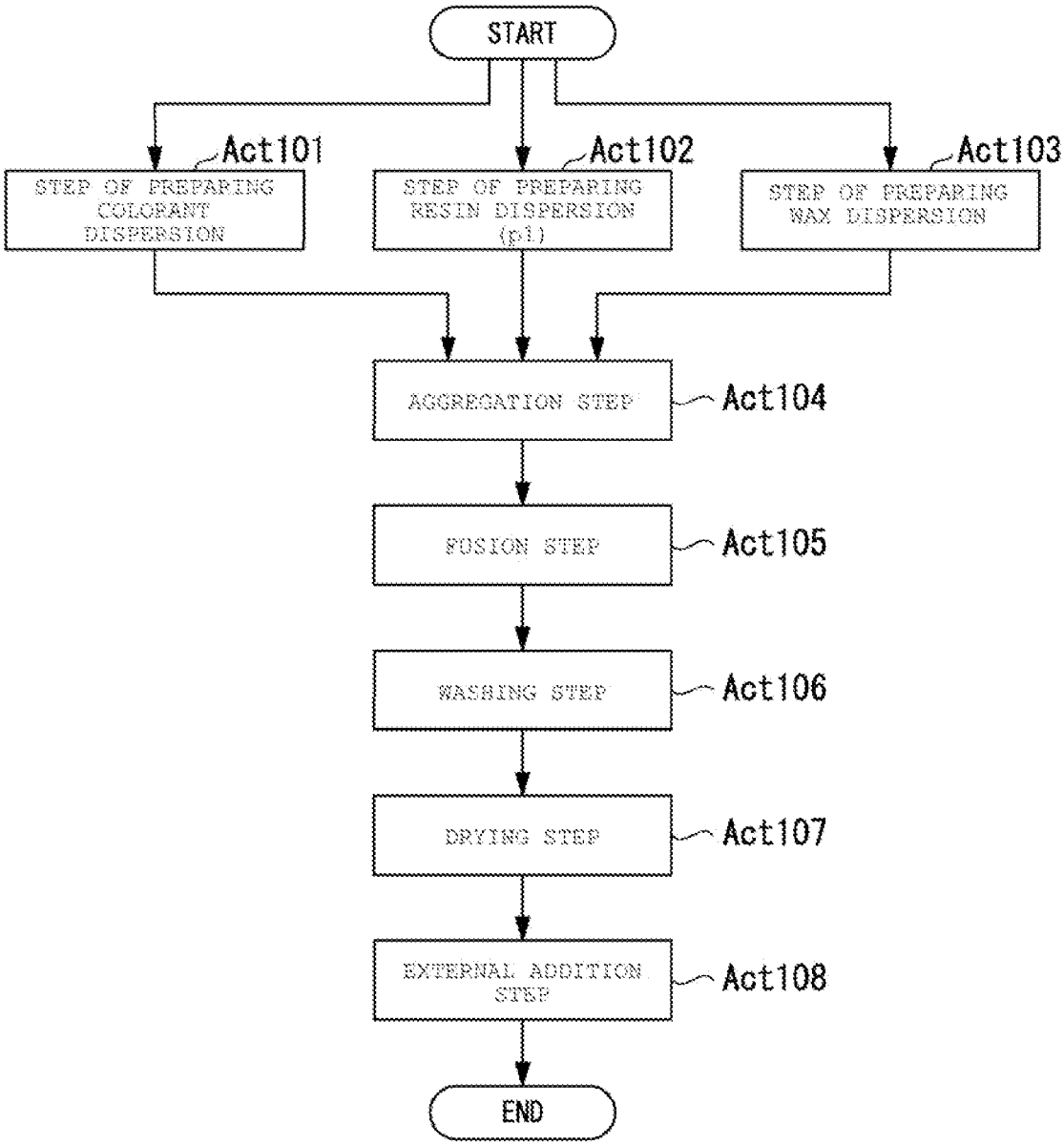
FIG. 1 illustrates steps for a method of producing an electrophotographic toner according to an embodiment.

FIG. 1 illustrates steps for a method of producing an electrophotographic toner according to a first embodiment. The present embodiment includes a step of preparing a colorant dispersion (Act101), a step of preparing a resin dispersion liquid (p1) (Act102), a step of preparing a wax dispersion liquid (Act103), an aggregation step (Act104), a fusion step (Act105), a washing step (Act106), a drying step (Act107), and an external addition step (Act108).

The aggregation step (Act104) according to the present embodiment has a first aggregation step (Act104-1) and a second aggregation step (Act104-2).

Hereinafter, the step of preparing a colorant dispersion liquid (Act101) will be described.

The colorant dispersion liquid contains colorant particles. The colorant dispersion liquid is prepared before the aggregation step is performed (Act101 of FIG. 1).

Examples of the colorant for preparing the colorant particles include carbon black, organic or inorganic pigments, and the like.

Examples of the carbon black include acetylene black, furnace black, thermal black, channel black, ketjen black, and the like.

Examples of the organic or inorganic pigments include first yellow G, benzidine yellow, India fast orange, IRGAZIN red, CARMIN FB, PERMANENT BORDEAUX FRR, PIGMENT ORANGE R, LITHOL RED 2G, LAKE RED C, RHODAMINE FB, RHODAMINE B LAKE, phthalocyanine blue, PIGMENT BLUE, BRILLIANT GREEN B, phthalocyanine green, quinacridone, pearlescent pigments, and the like. Examples of the pearlescent pigments include pigments obtained by covering flaky mica with a metal oxide such as titanium oxide or iron oxide, and the like.

One kind of the colorant may be used singly or two or more kinds thereof may be used in combination.

Among the colorants, the organic or inorganic pigments are preferable since these easily exhibit excellent image quality, and among these, the pearlescent pigments are particularly preferable.

Examples of a dispersion medium in the colorant dispersion liquid include water, mixed solvents consisting of water and an organic solvent, and the like. Among these, water is preferable.

The colorant dispersion liquid may contain other components, in addition to the colorant and the dispersion medium. Examples of other components include a surfactant, a basic compound, and the like.

Examples of the surfactant include anionic surfactants such as a sulfuric ester salt, sulfonate, a phosphoric ester salt, and a soap; cationic surfactants such as an amine salt and a quaternary ammonium salt; nonionic surfactants such as a polyethylene glycol-based surfactant, an alkylphenol ethylene oxide adduct-based surfactant, and a polyol-based surfactant; and the like. The surfactant functions as a dispersant.

Examples of the basic compound include amine compounds and the like. Examples of the amine compounds include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, N,N-diethyl-1,3-diaminopropane, and the like. The basic compound functions as a dispersion aid.

The colorant dispersion liquid may be prepared by, for example, mixing a solution which is obtained by adding a colorant and optionally other components to a dispersion medium, by applying mechanical shearing force.

Examples of a mechanical shear apparatus that may be used to apply the shearing force include mechanical shear apparatuses not using media, such as ULTRA-TURRAX (manufactured by IKA JAPAN K.K.), TK AUTOHOMOMIXER (manufactured by PRIMIX CORPORATION), TK PIPELINE HOMO MIXER (manufactured by PRIMIX CORPORATION), TK FILMIX (manufactured by PRIMIX CORPORATION), CLEARMIX (manufactured by M TECHNIQUE CO., LTD.), CLEAR SS5 (manufactured by M TECHNIQUE CO., LTD), CAVITRON (manufactured by EUROTEC CO., LTD.), FINE FLOW MILL (manufactured by PACIFIC MACHINERY & ENGINEERING CO., LTD.), MICROFLUIDIZER (manufactured by MIZUHO INDUSTRIAL CO., LTD.), ULTIMIZER (manufactured by SUGINO MACHINE LIMITED), NANOMIZER (manufactured by Yoshida Kikai Co., Ltd.), GENUS PY (manufactured by HAKUSUITECH CO., LTD.), and NANO3000 (manufactured by BERYU CORPORATION); and mechanical shear apparatuses using media, such as VISCOMILL (manufactured by AIMEX CO. LTD.), APEX MILL (manufactured by KOTOBUKI INDUSTRIES CO., LTD.), STAR MILL (manufactured by ASHISAWA FINETECH LTD.), DCP SUPERFLOW (manufactured by NIPPON EIRICH CO., LTD.), MP MILL (manufactured by INOUE MFG., INC), SPIKE MILL (manufactured by INOUE MFG., INC), MIGHTY MILL (manufactured by INOUE MFG., INC), and SC MILL (manufactured by MITSUI MINING CO., LTD.).

The average particle diameter of the colorant pigment contained in the colorant dispersion liquid is 6 μm or greater. If colorant particles having an average particle diameter of 6 μm or greater are used, sufficient image quality may be obtained. The average particle diameter of the colorant particles is preferably 6 μm to 100 μm. If the average particle diameter is less than 6 μm, sufficient image quality may not be obtained. If the average particle diameter exceeds 100 μm, the control of development or transfer in the electrophotographic system becomes difficult. From the viewpoint of the compatibility between controllability in the electrophotographic system and image quality, the average particle diameter of the colorant particles is preferably 10 μm to 60 μm.

In the present specification, the average particle diameter of particles may be measured using a laser diffraction-type particle diameter distribution analyzer.

The shape of the colorant particles is not particularly limited. For example, the colorant particles may have the shape of a flat plate, a cylinder, a sphere, and the like, and among these, the shape of a flat plate is preferable. If the colorant particles have the shape of a flat plate, at the time of forming an image, the colorant particles may be easily oriented in parallel with the surface of the image, whereby better image quality is easily obtained.

The average particle diameter and shape of the colorant particles may be controlled by regulating the mechanical shearing force of the mechanical shear apparatus.

The concentration of the colorant in the colorant dispersion liquid is not particularly limited, and is preferably from 2% by mass to 15% by mass.

Hereinafter, the step (Act102) of preparing the resin dispersion liquid (p1) will be described.

The resin dispersion liquid (p1) contains fine resin particles. The resin dispersion liquid (p1) is prepared before the aggregation step is performed (Act102 of FIG. 1).

Examples of the resin for preparing the fine resin particles include polyester-based resins, polystyrene-based resins, and the like.

As the polyester-based resins, the resins obtained by condensation polymerization of polyvalent carboxylic acid and polyol are preferable. Among these, polyester resins, which are obtained by the condensation polymerization of a dicarboxylic acid component and a diol component through an esterification reaction, are particularly preferable.

Examples of the dicarboxylic acid component include aromatic dicarboxylic acid such as terephthalic acid, phthalic acid, and isophthalic acid; aliphatic carboxylic acid such as fumaric acid, maleic acid, succinic acid, adipic acid, sebacic acid, glutaric acid, pimelic acid, oxalic acid, malonic acid, citraconic acid, and itaconic acid; and the like. Examples of the diol component include aliphatic diol such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diol such as 1,4-cyclohexanediol and 1,4-cyclohexanedimethanol; an ethylene oxide adduct or propylene oxide adduct such as bisphenol A; and the like. The polyester-based resins may be amorphous or crystalline.

As the polystyrene-based resins, the resins obtained by copolymerizing an aromatic vinyl compound and a (meth) acrylic acid ester component are preferable. The "(meth) acrylic acid ester" refers to at least one of the acrylic acid ester and methacrylic acid ester.

Examples of the aromatic vinyl component include styrene, α-methylstyrene, o-methylstyrene, p-chlorostyrene, and the like. Examples of the (meth)acrylic acid ester component include ethyl acrylate, propyl acrylate, butyl acrylate, 2-ethylhexyl acrylate, butyl methacrylate, ethyl methacrylate, methyl methacrylate, and the like. Among these, butyl acrylate is generally used. As the polymerization method thereof, an emulsion polymerization method is generally used. The polystyrene-based resin is obtained by, for example, performing radical polymerization of a monomer of each component in an aqueous phase containing an emulsifier.

The glass transition temperature of the polyester-based resin and the polystyrene-based resin may be appropriately set by those skilled in the art.

The average molecular weight (Mw) of the polyester-based resin is preferably 5,000 to 30,000. The Mw of the polystyrene-based resin is preferably 10,000 to 70,000. If the Mw of each of the resins is less than the preferable lower limit, heat-resistant storability of the toner easily deteriorates. The greater the Mw of each of the resins is, the higher the fixing temperature becomes. Therefore, if the Mw of each of the resins exceeds the preferable upper limit, it is not preferable from the viewpoint of decreasing power consumption during a fixing process.

In the present specification, the average molecular weight (Mw) of a resin is a value which is obtained by gel permeation chromatography and expressed in terms of polystyrene.

One kind of the resin may be used singly, or two or more kinds thereof may be used in combination.

Among the above resins, the polyester-based resin is preferable since the resin has a low glass transition temperature and exhibits excellent low-temperature fixability.

Examples of the dispersion medium in the resin dispersion liquid (p1) include water, a mixed solvent consisting of water and an organic solvent, and the like. Among these, water is preferable.

The resin dispersion liquid (p1) may contain other components in addition to the resin and the dispersion medium. Examples of other components include a surfactant, a basic compound, and the like. Examples of the surfactant and the basic compound that may be contained in the resin dispersion liquid (p1) include the same surfactants and basic compounds as being exemplified as other components that may be contained in the colorant dispersion liquid.

The resin dispersion liquid (p1) may be prepared by, for example, mixing a solution which is obtained by adding a resin and optionally other components to a dispersion medium, by applying mechanical shearing force. By applying the mechanical shearing force, the resin may be pulverized.

In the present specification, pulverization means a process by which the particle size of a particle mixture in a dispersion liquid is reduced compared to the particle size measured before the application of shearing force.

Examples of a mechanical shear apparatus which may be used for applying the mechanical shearing force to pulverize a resin, include the same mechanical shear apparatus as being able to be used for preparing the colorant dispersion liquid.

The average particle diameter of the fine resin particles contained in the resin dispersion liquid (p1) is not particularly limited, and is preferably 0.05 μm to 0.30 μm. The shape of the fine resin particles is not particularly limited. For example, the fine resin particles may have the shape of a sphere, a cylinder, a plate, and the like. Among these, fine resin particles having the shape of a sphere are preferable since such particles are easily aggregated with the colorant particles.

The average particle diameter and shape of the fine resin particles may be controlled by regulating the mechanical shearing force of the mechanical shear apparatus.

The concentration of the resin in the resin dispersion liquid (p1) is appropriately set according to the concentration or the like of the colorant. The concentration of the resin in the resin dispersion liquid (p1) is preferably from 20% by mass to 40% by mass.

Hereinafter, the step (Act103) of preparing a wax dispersion liquid will be described.

The wax dispersion liquid contains fine wax particles. The wax dispersion liquid is prepared before the aggregation step is performed (Act103 of FIG. 1).

Examples of the wax for preparing the fine wax particles include aliphatic hydrocarbon-based wax such as low-molecular weight polyethylene, low-molecular weight polypropylene, a polyolefin copolymer, polyolefin wax, microcrystalline wax, paraffin wax, FISCHER-TROPSH wax; oxides of aliphatic hydrocarbon-based wax, such as polyethylene oxide wax; block copolymers of these; plant wax such as candelilla wax, carnauba wax, Japan tallow, jojoba wax, and rice wax; animal wax such as beeswax, lanolin, and spermaceti; mineral wax such as ozokerite, ceresine, and petrolatum; ester wax containing fatty ester as a main component, such as palmitic acid ester wax, montanoic acid ester wax, and castor wax; the wax obtained by deoxidizing a part or all of aliphatic acid ester, such as deoxidized carnauba wax; saturated straight-chain fatty acid such as palmitic acid, stearic acid, montanoic acid, long-chain alkylcarboxylc acids having a longer-chain alkyl; unsaturated fatty acid such as brassidic acid, eleostearic acid, and parinaric acid; saturated alcohol such as stearyl alcohol, eicosyl alcohol, behenyl alcohol, carnaubyl alcohol, ceryl alcohol, melissyl alcohol, and long-chain alkyl alcohol having a longer-chain alkyl group; polyol such as sorbitol; fatty acid amide such as linolic acid amide, oleic acid amide, and lauric acid amide; saturated fatty acid bisamide such as methylene bisstearic acid amide, ethylene biscapric acid amide, ethylene bislauric acid amide, and hexamethylene bisstearic acid amide; unsaturated fatty acid amides such as ethylene bisoleic acid amide, hexamethylene bisoleic acid amide, N,N'-dioleyladipic acid amide, and N,N'-dioleylsebacic acid amide; aromatic bisamide such as m-xylylene bisstearic acid amide and N,N'-distearylisophthalic acid amide; fatty acid metal salts (metal soaps) such as calcium stearate, calcium laurate, zinc stearate, and magnesium stearate; the wax obtained by grafting a vinyl-based monomer such as styrene or acrylic acid to aliphatic hydrocarbon-based wax; partially esterified substances consisting of fatty acid and polyol, such as behenic acid monoglyceride; methyl ester compounds having a hydroxy group that are obtained by adding hydrogen to vegetable fat and oil; and the like.

One kind of the wax may be used singly, or two or more kinds thereof may be used in combination.

Among the above wax, the fatty acid hydrocarbon-based wax and the ester wax containing fatty acid ester as a main component are preferable, and paraffin wax and ester wax containing palmitic acid ester as a main component are more preferable since these excellently suppress occurrence of offset.

Examples of the dispersion medium in the wax dispersion liquid include water, a mixed solvent consisting of water and an organic solvent, and the like. Among these, water is preferable.

The wax dispersion liquid may contain other components, in addition to the resin and the dispersion medium. Examples of other components include a surfactant, a basic compound, and the like. Examples of the surfactant and the basic compound that may be contained in the wax dispersion liquid include the same surfactant and basic compound as being exemplified as other components that may be contained in the colorant dispersion liquid.

The wax dispersion liquid may be prepared by, for example, mixing a solution, which is obtained by adding wax and optionally other components to a dispersion medium, by applying mechanical shearing force. By the application of the mechanical shearing force, the wax may be pulverized.

Examples of a mechanical shear apparatus which may be used for applying the mechanical shearing force to pulverize wax, include the same mechanical shear apparatus as being able to be used for preparing the colorant dispersion liquid.

The average particle diameter of the fine wax particles contained in the wax dispersion liquid is not particularly limited, and is preferably from 0.05 μm to 0.30 μm. The shape of the fine wax particles is not particularly limited. For example, the fine wax particles may have the shape of a sphere, a cylinder, a plate, and the like. Among these, fine wax particles having the shape of a sphere are preferable since such particles are easily aggregated with the fine resin particles and the colorant particles.

The average particle diameter and shape of the fine wax particles may be controlled by regulating the mechanical shearing force of the mechanical shear apparatus.

The concentration of the wax in the wax dispersion liquid is appropriately set according to the concentration of the colorant, the type of the resin, and the like. The concentration of the wax in the wax dispersion liquid is preferably from 30% by mass to 50% by mass.

Hereinafter, the aggregation step (Act104) will be described.

Figure 2:
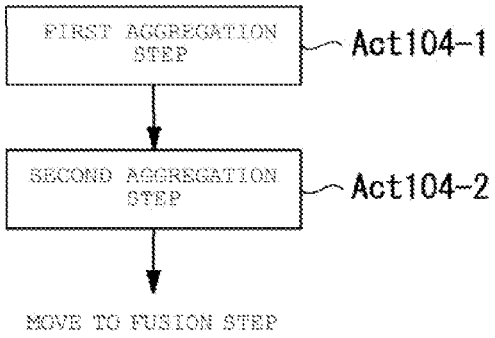
FIG. 2 illustrates a detail of an aggregation step from FIG. 1.

FIG. 2 is a view illustrating an embodiment of the aggregation step (Act104). The aggregation step according to the present embodiment has a first aggregation step (Act104-1) and a second aggregation step (Act104-2).

Hereinafter, the first aggregation step (Act104-1) will be described.

In the first aggregation step, the resin dispersion liquid (p1) and the wax dispersion liquid are added simultaneously or in this order to the colorant dispersion liquid. As a result, heteroaggregation occurs among the colorant particles, the fine resin particles, and the fine wax particles. In this manner, aggregates in which the surface of the colorant particles is covered with the fine resin particles and the fine wax particles are obtained. In the present specification, "heteroaggregation" means that the fine resin particles and the fine wax particles are aggregated onto the colorant particles.

The first aggregation step may be performed in a container that is generally used for an aggregation reaction. The reaction volume is appropriately set to various levels within a range of a laboratory scale to an industrial scale.

When the resin dispersion liquid (p1) and the wax dispersion liquid are added simultaneously, a mixed solution that is obtained in advance by mixing both the dispersion liquids with each other may be added, or alternatively, both the dispersion liquids may be independently added simultaneously.

The mixing ratio (mass ratio) between the resin and the wax in the mixed solution consisting of the resin dispersion liquid (p1) and the wax dispersion liquid is preferably from 5:1 to 1:3 (resin:wax).

When the resin dispersion liquid (p1) and the wax dispersion liquid are added in this order, the wax dispersion liquid may be continuously or intermittently added after the addition of the resin dispersion liquid (p1) ends.

When the resin dispersion liquid (p1), the wax dispersion liquid, or the mixed solution consisting of both the dispersion liquids (other dispersion liquids or the mixed solution thereof) is added to the colorant dispersion liquid, it is preferable to take time to add other dispersion liquids or the mixed solution thereof little by little to the whole colorant dispersion liquid. Each of the above other dispersion liquids or the mixed solution thereof may be continuously or intermittently added by a predetermined amount. Particularly, it is preferable for each of the resin dispersion liquid (p1), the wax dispersion liquid, or the mixed solution consisting of the both dispersion liquids to be continuously added by a predetermined amount. If the method of continuous addition is used, heteroaggregation more easily occurs among the colorant particles, the fine resin particles, and the fine wax particles. Furthermore, it is easy to obtain aggregates in which the surface of the colorant particles is sufficiently covered with the fine resin particles and the fine wax particles. In the case of the continuous addition, it is preferable to add the resin dispersion liquid (p1), the wax dispersion liquid, or the mixed solution consisting of both the dispersion liquids to the colorant dispersion liquid at a constant addition speed. The addition speed is appropriately set according to the mixing scale or the like.

In the first aggregation step, the amount of the resin added is preferably 3 parts by mass or more based on 100 parts by mass of an amount of the wax added. If the amount of the resin added is equal to or less than the preferable lower limit, the colorant particles are easily aggregated with the fine wax particles. Consequently, the number of particles of the wax alone in the toner is further reduced. Moreover, generation of particles having a large area where the colorant or wax is exposed is easily suppressed. The amount of the resin added is preferably 3 parts by mass to 400 parts by mass, and more preferably 3 parts by mass to 100 parts by mass, based on 100 parts by mass of the amount of the wax added.

When the resin dispersion liquid (p1), the wax dispersion liquid, or the mixed solution consisting of both the dispersion liquids is added to the colorant dispersion liquid, if necessary, optional components may be added. Examples of the optional components include an aggregation agent, a charge control agent, and the like.

The aggregation agent is optionally used to accelerate the aggregation of the colorant particles, the fine resin particles, and the fine wax particles. Examples of the aggregation agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; non-metal salts such as ammonium chloride and ammonium sulfate; inorganic metal salt polymers such as polyaluminum chloride, polyaluminum hydroxide, and calcium polysulfide; polymeric aggregation agents such as polymethacrylic acid ester, polyacrylic acid ester, polyacrylamide, and an acrylamide-sodium acrylate copolymer; coagulants such as polyamine, poly diallyl ammonium halide, a melamine formaldehyde condensate, and dicyandiamide; alcohols such as methanol, ethanol, 1-propanol, 2-propanol, 2-methyl-2-propanol, 2-methoxyehoxyethanol, 2-ethoxyethanol, and 2-butoxyethanol; organic solvents such as acetonitrile and 1,4-dioxane; inorganic acid such as hydrochloric acid and nitric acid; organic acid such as formic acid and acetic acid; and the like. Among these, non-metal salts are preferable, and ammonium sulfate is more preferable, since the agent exhibits a high aggregation accelerating effect.

The charge control agent is used to control chargeability of the toner and makes it easy for the toner to be transferred to a medium such as paper. Examples of the charge control agent include metal-containing azo compounds, metal-containing salicylic acid derivative compounds, and the like. Among the metal-containing azo compounds, complexes or complex salts containing iron, cobalt, or chromium as a metal, or mixtures of these are preferable. Among the metal-containing salicylic acid derivative compounds, complexes or complex salts containing zirconium, zinc, chromium, or boron as a metal, or mixtures of these are preferable.

Hereinafter, the second aggregation step (Act104-2) will be described.

In the second aggregation step, after the first aggregation step, a resin dispersion liquid (p2) containing a resin is further added. As a result, the surface of the aggregate obtained in the first aggregation step is covered with fine resin particles in the resin dispersion liquid (p2). Consequently, the toner containing a small number of particles of a pigment alone or the toner containing a large number of the particles having a small area where the pigment is exposed is more easily obtained.

The resin dispersion liquid (p2) contains fine resin particles. Examples of the resin for preparing the fine resin particles in the resin dispersion liquid (p2) include polyester-based resins, polystyrene-based resins, and the like. Examples of the polyester-based resins and the polystyrene-based resins include the same polyester-based resins and polystyrene-based resins as being exemplified in the description for the resin dispersion liquid (p1). The resin in the resin dispersion liquid (p2) may be the same as or different from the resin in the resin dispersion liquid (p1).

Examples of a dispersion medium in the resin dispersion liquid (p2) include water, a mixed solvent consisting of water and an organic solvent, and the like. Among these, water is preferable.

The resin dispersion liquid (p2) may contain other components, in addition to the resin and the dispersion medium. Examples of other components include a surfactant, a basic compound, and the like. Examples of the surfactant and the basic compound include the same surfactants and basic compounds as being exemplified in the description for the resin dispersion liquid (p1).

The resin dispersion liquid (p2) may be prepared in the same manner as in the case of the resin dispersion liquid (p1).

The average particle diameter of the fine resin particles contained in the resin dispersion liquid (p2) is not particularly limited, and is preferably from 0.05 μm to 0.3 μm. The shape of the fine resin particles is not particularly limited. For example, the fine resin particles may have the shape of a sphere, a cylinder, a plate, and the like. Among these, fine resin particles having the shape of a sphere are preferable since such particles are easily aggregated with the aggregates obtained in the first aggregation step.

The concentration of the resin in the resin dispersion liquid (p2) is appropriately set according to the composition and the like of the aggregate, and preferably from 10% by mass to 40% by mass.

When being added to the dispersion liquid containing the aggregates obtained in the first aggregation step, the resin dispersion liquid (p2) may be added continuously or intermittently by a predetermined amount. Particularly, it is preferable for the resin dispersion liquid (p2) to be continuously added by a predetermined amount. If the method of continuous addition is used, the surface of the aggregates obtained in the first aggregation step may be sufficiently covered with the fine resin particles contained in the resin dispersion liquid (p2). In the case of the continuous addition, it is preferable to add the resin dispersion liquid (p2) to the colorant dispersion liquid at a constant addition speed. The addition speed is appropriately set according to the mixing scale or the like.

In the second aggregation step, when the addition of the resin dispersion liquid (p2) was ended, the amount of the wax added is preferably 90% by mass or more of the total amount of the wax to be added. If the amount of the wax added is equal to or greater than the preferable lower limit, this makes it easy for the wax to be disposed near the surface of the toner. Accordingly, a toner having excellent image quality, developability, transferability, filming properties, and offset properties is easily obtained. The amount of the wax added is more preferably from 90% by mass to 100% by mass based on the total amount of the wax to be added.

In the present specification, the total amount of the wax to be added means the total amount of the wax that is to be mixed in during the production of the toner. The total amount of the resin to be added means the total amount of the resin that is to be mixed in during the production of the toner.

The amount of the resin added in the second aggregation step is not particularly limited, and is appropriately set in consideration of the amount of other components added. For example, the amount of resin added is preferably from 10% by mass to 50% by mass of the total amount of the resin to be added.

When the resin dispersion liquid (p2) is added to the dispersion liquid containing the aggregates obtained in the first aggregation step, if necessary, optional components may be added. Examples of the optional components include an aggregation agent, a charge control agent, and the like. Examples of the aggregation agent and the charge control agent include the same aggregation agent and charge control agent as being exemplified in the description for the first aggregation step.

Hereinafter, the fusion step (Act105) will be described.

The fusion step according to the present embodiment is a step of heating the aggregates obtained in the aggregation step. By this step, the colorant particles, the fine resin particles, and the fine wax particles included into the aggregates are fused with one another, whereby fused particles are obtained. The fusion step may be performed simultaneously with the aggregation step.

The heating temperature of the aggregates is appropriately set. For example, the heating temperature of the aggregates is preferably from the glass transition temperature of the fine resin particles to the glass transition temperature +40° C. The heating time is preferably from 2 to 10 hours.

The average particle diameter of the fused particles obtained after the fusion step is preferably from 7 μm to 150 μm and more preferably from 10 μm to 100 μm.

Hereinafter, the washing step (Act106) will be described.

The washing step according to the present embodiment is a step of washing the fused particles obtained after the fusion step. The washing step is performed by a known washing method. For example, the washing step is performed by repeating washing using deionized water and filtration. It is preferable for the washing step to be repeated until the conductivity of the filtrate becomes, for example, 50 μS/cm or less.

Hereinafter, the drying step (Act107) will be described.

The drying step according to the present embodiment is a step of drying the fused particles obtained after the washing step. The drying step is performed appropriately by a known drying method. For example, the drying step is performed using a vacuum drier. It is preferable for the drying step to be performed until the moisture content of the fused particles become, for example, 1.0% by mass or less.

Hereinafter, the external addition step (Act108) will be described.

The external addition step according to the present embodiment is a step of adding an external additive to the fused particles obtained after the drying step.

The external additive is optionally added for the purpose of imparting fluidity to the toner, adjusting chargeability, or the like. Examples of the external additive include inorganic oxide particles such as silica particles and titanium oxide, inorganic oxide particles having undergone surface treatment with a hydrophobizing agent, and the like.

In the method of producing an electrophotographic toner according to the first embodiment, aggregates are obtained by adding the resin dispersion liquid and the wax dispersion liquid to the colorant dispersion liquid in the aggregation step (first aggregation step). As a result, the colorant particles included into the toner produced by the production method maintain their particle size (average particle diameter of 6 μm or greater) and shape without being ground. Moreover, since heteroaggregation easily occurs among the colorant particles, the fine resin particles, and the fine wax particles, aggregates not containing the colorant particles are not easily formed. In addition, in the aggregation step according to the first embodiment, aggregates are obtained by further adding the resin dispersion liquid (p2) to the dispersion liquid containing the aggregates obtained in the first aggregation step (second aggregation step). As a result, the aggregates formed by the heteroagqreqation are covered with the fine resin particles. That is, the aggregates in which the surface of the colorant particles is sufficiently covered with the fine resin particles and the fine wax particles are reliably obtained. Furthermore, the number of particles of pigment alone is reduced, and the area where the pigment is exposed is also reduced. Moreover, when an image is formed of the toner produced by the production method, the colorant particles are easily oriented in parallel with the surface of the image. Accordingly, by the production method, a toner exhibiting sufficient image quality is produced.

In the method of producing an electrophotographic toner according to the first embodiment, the resin dispersion liquid and the wax dispersion liquid are added simultaneously or in this order to the colorant dispersion liquid. As a result, many fine wax particles adhere to the colorant particles. In the first aggregation step, the adherence of the fine resin particles to the colorant particles and the adherence of the fine wax particles to the colorant particles occur at the same time. Presumably, at this time, the motion of the fine resin particles heading toward the colorant particles may make it easy for the fine wax particles to adhere to the colorant particles. Alternatively, presumably, as the fine wax particles are absorbed into the fine resin particles, the fine wax particles may easily adhere to the colorant particles. In the production method, according to the order of adding the wax dispersion liquid, the orientation of the wax in the toner may be controlled. Therefore, by the production method, an electrophotographic toner that does not easily cause fogging or offset is produced.

In the method of producing an electrophotographic toner according to the first embodiment, between the first and second aggregation steps, the wax dispersion liquid may be further added. Moreover, in the method of producing an electrophotographic toner according to the first embodiment, the wax dispersion liquid may be further added after the second aggregation step.

Second Embodiment

The method of producing an electrophotographic toner according to a second embodiment includes a step of preparing a colorant dispersion liquid (Act101), a step of preparing a resin dispersion liquid (p1) (Act102), a step of preparing a wax dispersion liquid (Act103), an aggregation step (Act104'), a fusion step (Act105), a washing step (Act106), a drying step (Act107), and an external addition step (Act108).

The aggregation step (Act104') according to the second embodiment includes only a first aggregation step (Act104-1).

The description for each step according to the second embodiment is the same as the description for each step according to the first embodiment.

In the aggregation step (Act104'), the amount of the resin is preferably 3 parts by mass or more based on 100 parts by mass of an amount of the wax added. If the amount of the resin added is equal to or greater than the preferable lower limit, the colorant particles are easily aggregated with the fine wax particles. As a result, the number of particles of wax alone in the toner is reduced. Moreover, generation of particles having a large area where the colorant or wax is exposed is easily suppressed. The amount of the resin added is preferably 3 parts by mass to 400 parts by mass, and more preferably 3 parts by mass to 100 parts by mass, based on 100 parts by mass of the amount of the wax added.

In the aggregation step (Act104'), when the addition of the resin dispersion liquid (p1) was ended, the amount of the wax added is preferably 90% by mass or more of the total amount of the wax to be added. If the amount of the wax added is equal to or greater than the preferable lower limit, this makes it easy for the wax to be disposed near the surface of the toner. Accordingly, a toner having excellent image quality, developability, transferability, filming properties, and offset properties is easily obtained. The amount of the wax added is more preferably 90% by mass to 100% by mass based on the total amount of the wax to be added.

According to the method of producing an electrophotographic toner according to the second embodiment, a toner exhibiting sufficient image quality is produced, since the method includes the first aggregation step. Moreover, according to the method of producing an electrophotographic toner according to the second embodiment, an electrophotographic toner that does not easily cause fogging or offset is produced.

In the method of producing an electrophotographic toner according to the second embodiment, the wax dispersion liquid may be further added after the first aggregation step.

Third Embodiment

An electrophotographic toner according to a third embodiment is an electrophotographic toner produced by the aforementioned production method.

The average particle diameter of the electrophotographic toner is preferably from 7 μm to 150 μm, and more preferably from 10 μm to 100 μm. If the average particle diameter of the toner is equal to or greater than the preferable lower limit, a desirable image quality is easily obtained. If the average particle diameter of the toner is equal to or smaller than the preferable upper limit, the control of development or transfer of electrophotography becomes easy.

The content of the colorant in the toner is preferably 5% by mass to 60% by mass, and more preferably from 15% by mass to 50% by mass, based on the total amount (excluding the external additive) of the toner. If the content of the colorant is less than the preferable lower limit, image quality is not obtained. If the content of the colorant exceeds the preferable upper limit, fixability and fastness of the image easily deteriorate.

The content of the resin in the toner is preferably 30% by mass to 90% by mass based on the total amount (excluding the external additive) of the toner. If the content of the resin is less than the preferable lower limit, fixability and fastness of the image are not easily secured. If the content of the resin exceeds the preferable upper limit, fixability, offset properties, and desirable image quality are not easily secured.

The content of the wax in the toner is preferably 3% by mass to 30% by mass, more preferably 5% by mass to 20% by mass, based on the total amount (excluding the external additive) of the toner. If the content of the wax is less than the preferable lower limit, offset properties becomes insufficient, and fixability is not easily secured. If the content of the wax exceeds the preferable upper limit, filming easily occurs.

The electrophotographic toner according to the third embodiment is produced by the aforementioned production method. Accordingly, sufficient image quality is obtained, and fogging or offset does not easily occur.

The toner according to the present embodiment may be preferably used for a nonmagnetic single-component developer or a two-component developer. The toner may be used for forming an image on an electrophotographic recording medium, by being loaded on an image forming apparatus such as Multi Function Peripheral (MFP). When the toner is used for a two-component developer, the usable carrier is not particularly limited and may be appropriately selected by those skilled in the art.

Fourth Embodiment

A toner cartridge according to a fourth embodiment includes a container and the electrophotographic toner produced by the aforementioned production method that is accommodated in the container. With respect to the container, it is possible to use a container having the known form.

If printing is performed using the toner cartridge according to the fourth embodiment, it is possible to obtain an image that exhibits sufficient image quality and does not show fogging or offset.

Fifth Embodiment

An image forming apparatus according to a fifth embodiment includes a body of the apparatus and the electrophotographic toner produced by the aforementioned production method that is accommodated in the body. As the body of the apparatus, it is possible to use a general electrophotographic apparatus.

Figure 3:
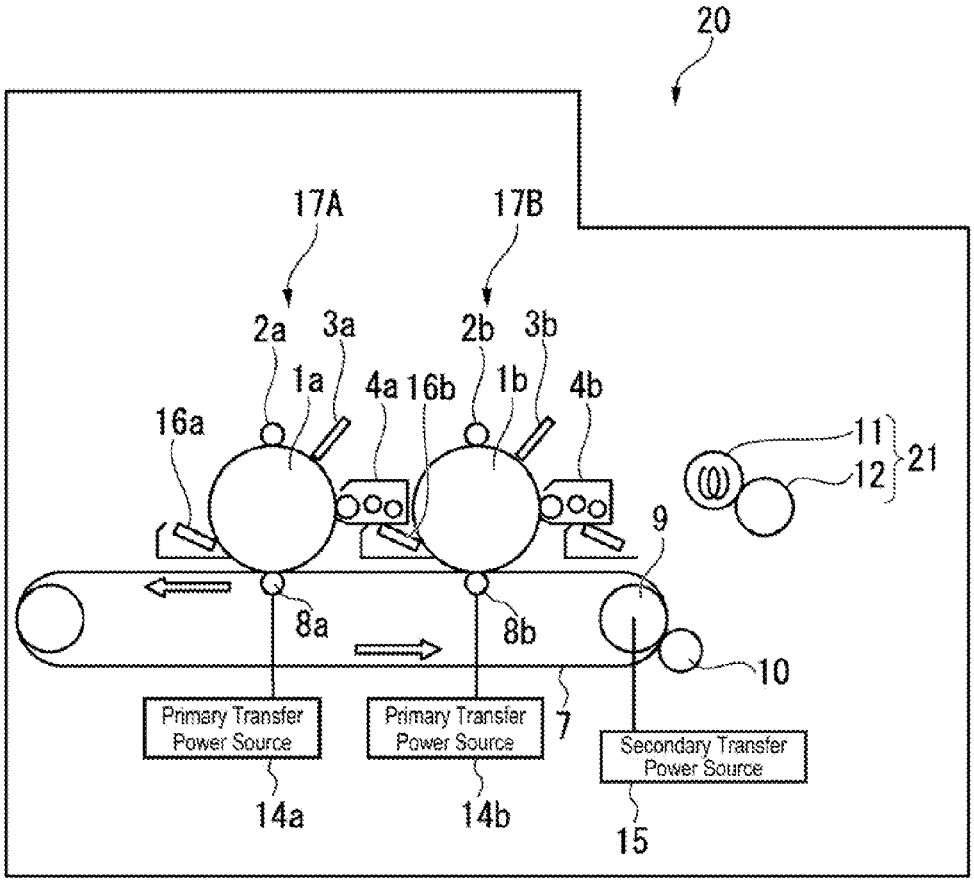
FIG. 3 illustrates an image forming apparatus.

FIG. 3 is a view schematically illustrating an example structure of the image forming apparatus according to the fifth embodiment.

As illustrated in the drawing, an image forming apparatus 20 has a body including an intermediate transfer belt 7, a first image forming unit 17A and a second image forming unit 17B that are disposed in this order on the intermediate transfer belt 7, and a fixing device 21 that is disposed in the downstream thereof. In the direction in which the intermediate transfer belt 7 moves, that is, in the direction in which the image forming process is performed, the first image forming unit 17A is positioned in the downstream of the second image forming unit 17B.

The first image forming unit 17A has a photoreceptor drum 1*a*, and a cleaning device 16*a*, a charging device 2*a*, an exposure device 3*a*, and a first developing unit 4*a* that are disposed in this order on the photoreceptor drum 1*a*, and a primary transfer roller 8*a* that is disposed to face the photoreceptor drum 1*a* across the intermediate transfer belt 7.

The second image forming unit 17B has a photoreceptor drum 1*b*, and a cleaning device 16*b*, a charging device 2*b*, an exposure device 3*b*, and a second developing unit 4*b* that are disposed in this order on the photoreceptor drum 1*b*, and a primary transfer roller 8*b* that is disposed to face the photoreceptor drum 1*b* across the intermediate transfer belt 7.

The first developing unit 4*a* and the second developing unit 4*b* accommodate the electrophotographic toner produced by the production method according to the aforementioned embodiments. The electrophotographic toner may be supplied from a toner cartridge not illustrated in the drawing.

The primary transfer roller 8*a* and primary transfer roller 8*b* are connected to primary transfer power sources 14*a* and 14*b* respectively.

In the downstream of the second image forming unit 17B, a secondary transfer roller 9 and a backup roller 10 are disposed such that the rollers face each other across the intermediate transfer belt 7. The secondary transfer roller 9 is connected to a secondary transfer power source 15.

The fixing device 21 has a heat roller 11 and a press roller 12 that are disposed facing each other.

By using the image forming apparatus 20 of FIG. 3, an image may be formed by, for example, the following method.

First, the photoreceptor drum 1*b* is evenly charged by the charging device 2*b*.

Next, exposure is performed by the exposure device 3*b*, whereby an electrostatic latent image is formed. Thereafter, the image is developed with the toner supplied from the second developing unit 4*b*, whereby a second toner image is obtained.

Subsequently, the photoreceptor drum 1*a* is evenly charged by the charging device 2*a*.

Next, based on first image information (second toner image), exposure is performed by the exposure device 3*a*, whereby an electrostatic latent image is formed. Thereafter, the image is developed with the toner supplied from the first developing unit 4*a*, whereby a first toner image is obtained.

The second toner image and the first toner image are transferred in this order onto the intermediate transfer belt 7 by the primary transfer rollers 8*a* and 8*b*.

The image formed from the second toner image and the first toner image are layered on the intermediate transfer belt 7 in this order, is transferred by secondary transfer onto a recording medium (not illustrated in the drawing) via the secondary transfer roller 9 and the backup roller 10. As a result, an image formed from layers of the first toner image and the second toner image, in that order, is made on the recording medium.

The type of colorant used for the toner in the first developing unit 4*a* and the second developing unit 4*b* is optionally selected. The image forming apparatus 20 illustrated in the drawing uses two developing units. However, depending on the type of toner used, the image forming apparatus may have three or more developing units.

According to the image forming apparatus according to the fifth embodiment, it is possible to form an image that exhibits sufficient image quality and does not show fogging or setoff.

According to at least one of the embodiments described above, a toner may be produced by an aggregation method. As a result, a toner in which the particle size (average particle diameter of 6 μm or greater) and shape of colorant particles are maintained is produced. Moreover, in the aforementioned aggregation step, the resin dispersion liquid and the wax dispersion liquid are added simultaneously or in this order to the colorant dispersion liquid. Accordingly, many fine wax particles adhere to the colorant particles. Consequently, a toner is obtained in which the surface of the colorant particles having a large average particle diameter is sufficiently covered with the fine resin particles and the fine wax particles. Therefore, when an image is formed using the toner, sufficient image quality is obtained, and fogging or offset does not easily occur.

The following examples describe an example according to the present embodiments. However, the present embodiments are not limited to the examples.

Hereinafter, the evaluation of image quality will be described.

The toner produced in each example was mixed with a ferrite carrier covered with a silicone resin, thereby preparing a developer. At this time, the concentration of the ferrite carrier in the developer was set such that the concentration became 8% by mass based on the toner.

A toner cartridge filled with the developer was installed in an electrophotographic multifunction machine (e-studio 2050c) manufactured by TOSHIBA TEC CORPORATION. Thereafter, the fixing temperature was set to 150° C., and a solid image was printed on black paper. Subsequently, the image quality was evaluated by visual observation. The evaluation of image quality was selected from the following categories:

A: The solid image does not show unevenness and exhibits sufficient image quality.

B: The solid image shows slight unevenness but exhibits sufficient image quality.

C: The solid image shows serious unevenness and exhibits a low degree of acceptable image quality.

D: The solid image shows extremely serious unevenness and practically does not exhibit acceptable image quality.

Hereinafter, the evaluation of offset properties will be described.

After the solid image was printed on black paper to evaluate image quality, white paper was passed through the electrophotographic multifunction machine. Subsequently, the solid image printed on black paper and the white paper which had been passed through the electrophotographic multifunction machine were visually observed so as to evaluate offset properties. The evaluation of offset properties was selected from the following categories:

A: There is no trace of offset in both the solid image and white paper.

B: In the solid image, no trace of offset is confirmed. On the contrary, in the white paper, the portion of offset that was fixed to 1 or 2 points is found, but it is unproblematic in practical use.

C: In the solid image, no trace of offset is confirmed. On the contrary, in the white paper, the portion of offset that was fixed to several points is found, but it is unproblematic in practical use.

D: In the solid image, no trace of offset is confirmed. On the contrary, in the white paper, the portion of offset that was fixed to here and there is found, and it is problematic in practical use.

E: The trace of offset is found in the solid image.

Hereinafter, the evaluation of fogging will be described.

A developer was prepared in the same manner as in the case of the developer prepared for the evaluation of image quality.

A toner cartridge filled with the developer was installed in an electrophotographic multi function machine (e-studio 2050c) manufactured by TOSHIBA TEC CORPORATION, and a chart without a printing portion was printed on black paper. Thereafter, fogging on the paper was evaluated by visual observation. The evaluation of fogging was selected from the following categories: A: Fogging is not confirmed by visual observation, and it is at an excellent level.

B: A slight degree of fogging is found, but it is at a level unproblematic in practical use.

C: Fogging is observed here and there throughout the entire surface of the image, and it is at a level problematic in practical use.

D: Fogging was occurred seriously throughout the entire surface of the image, and it is at a level that makes it hard to control development and transfer by electrophotography.

Hereinafter, the evaluation of filing will be described.

A developer was prepared in the same manner as in the case of the developer prepared for the evaluation of image quality.

A toner cartridge filled with the developer was installed in an electrophotographic multifunction machine (e-studio 2050c) manufactured by TOSHIBA TEC CORPORATION.

Thereafter, a 6% chart was continuously printed on 10,000 sheets, and then a solid image was printed on black paper. Subsequently, the solid image and the exterior of the photoreceptor drum were visually observed to evaluate filming. The evaluation of filming was selected from the following categories:

A: Filming was not occurred in both the image and the photoreceptor drum.

B: Filming was not occurred in the image. On the contrary, filming was occurred at 1 or 2 points on the photoreceptor drum, but it is unproblematic in practical use.

C: Several voids or one or two streaks that are considered to be caused by filming are confirmed in the image. It is slightly problematic, but the image has practicality.

D: Many voids or streaks that are considered to be caused by filming were formed throughout the surface of the image, and it is seriously problematic.

Example 1

Hereinafter, the process of preparing a colorant dispersion liquid A will be described.

A mixed solution was prepared with 7 parts by mass of a cyan pigment (copper phthalocyanine pigment) as a colorant, 0.1 parts by mass of sodium dodecylbenzenesulfonate as an anionic surfactant, 0.1 parts by mass of triethylamine as an amine compound, and 92.8 parts by mass of deionized water, all mixed together with a CLEARMIX. The mixed solution was heated to 30° C. in the CLEARMIX. Thereafter, the rotation frequency of the CLEARMIX was set to 300 rpm, and mechanical shearing was performed for 10 minutes, thereby obtaining a colorant dispersion liquid A. As a result of measuring the colorant dispersion liquid A by using SALD-7000 (manufactured by SHIMADZU CORPORATION), the average particle diameter (50% D) of the colorant particles was confirmed to be 95 μm.

Hereinafter, the process of preparing a resin dispersion liquid will be described.

As a resin, a polyester resin obtained by condensation polymerization of terephthalic acid and ethylene glycol was used.

A mixed solution was prepared with 30 parts by mass of the polyester resin, 3 parts by mass of sodium dodecylbenzenesulfonate as an anionic surfactant, 1 part by mass of triethylamine as an amine compound, and 66 parts by mass of deionized water, all mixed together by using CLEARMIX. The mixed solution was heated to 80° C. in the CLEARMIX. Thereafter, the rotation frequency of the CLEARMIX was set to 6,000 rpm, and mechanical shearing was performed for 30 minutes. After the mechanical shearing ended, the mixed solution was cooled to room temperature, thereby obtaining a resin dispersion liquid. As a result of measuring the resin dispersion liquid by using SALD-7000 (manufactured by SHIMADZU CORPORATION), the average particle diameter (50% D) of the fine resin particles was confirmed to be 0.16 μm.

Hereinafter, the process of preparing a wax dispersion liquid will be described.

As a wax, ester wax containing palmitic acid ($C_{16}H_{32}O_2$) as a main component was used.

A mixed solution was prepared with 40 parts by mass of the ester wax, 4 parts by mass of sodium dodecylbenzenesulfonate as an anionic surfactant, 1 part by mass of triethylamine as an amine compound, and 55 parts by mass of deionized water, all mixed together with the CLEARMIX. The mixed solution was heated to 80° C. in the CLEARMIX. Thereafter, the rotation frequency of the CLEARMIX was set to 6,000 rpm, and mechanical shearing was performed for 30 minutes. After the mechanical shearing ended, the mixed solution was cooled to room temperature, thereby obtaining a wax dispersion liquid. As a result of measuring the wax dispersion liquid by using SALD-7000 (manufactured by SHIMADZU CORPORATION), the average particle diameter (50% D) of the fine wax particles was confirmed to be 0.20 μm.

Hereinafter, the process of preparing a mixed solution A consisting of the resin dispersion liquid and the wax dispersion liquid will be described.

A mixed solution was prepared with 35 parts by mass of the resin dispersion liquid, 26 parts by mass of the colorant dispersion liquid, and 39 parts by mass of deionized water, all put into a flask and stirred.

Hereinafter, the operation from the aggregation step to the external addition step will be described.

Colorant dispersion liquid A, in the amount of 150 parts by mass, was put into a flask, and 3 parts by mass of a 10% by mass aqueous ammonium sulfate solution was added thereto under stirring. Thereafter, while the resultant solution was being stirred, 23 parts by mass of the mixed solution A was added to the upper portion of the surface of the solution under stirring, at a speed of 0.12 parts by mass/min by using MASTERFLEX tube pump system (manufactured by YAMATO SCIENTIFIC CO., LTD.: inner diameter of tube of 0.8 mm). In this manner, by simultaneously adding the resin dispersion liquid and the wax dispersion liquid to the colorant dispersion liquid A, a dispersion liquid containing first aggregates was obtained (first aggregation step).

Subsequently, 5 parts by mass of a 10% by mass aqueous ammonium sulfate solution was added to the dispersion liquid containing the first aggregates. Thereafter, 50 parts by mass of the resin dispersion liquid was further added thereto under stirring, at a speed of 0.12 parts by mass/min by using the MASTERFLEX tube pump system, thereby obtaining a dispersion liquid containing second aggregates (second aggregation step).

Next, the temperature of the dispersion liquid containing the second aggregates was increased to 65° C. to cause fusion (fusion step). As a result of measuring the dispersion liquid obtained after the fusion by using SALD-7000 (manufactured by Shimadzu Corporation), the average particle diameter (50% D) of the fused particles containing in the dispersion liquid was confirmed to be 115 μm.

Thereafter, the dispersion liquid obtained after fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (manufactured by ZEPPELIN SYSTEMS, GMBH) (external addition step).

A toner of Example 1 was obtained as above. The average particle diameter (50% D) of the finally obtained toner was 115 μm.

Example 2

An amount of 300 parts by mass of the colorant dispersion liquid A was put into a flask, and 1 part by mass of a 10% by mass aqueous ammonium sulfate solution was added thereto under stirring. Thereafter, while the resultant solution was being stirred, 3 parts by mass of the resin dispersion liquid was added to the upper portion of the surface of the solution under stirring, at a speed of 0.11 parts by mass/min by using the MASTERFLEX tube pump system (manufactured by YAMATO SCIENTIFIC CO. LTD.: inner diameter of tube of 0.8 mm).

Subsequently, 3 parts by mass of a 10% by mass aqueous ammonium sulfate solution was added thereto, and while the resultant solution was being stirred, 15 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the colorant dispersion liquid A, thereby obtaining a dispersion liquid containing first aggregates (first aggregation step).

Thereafter, 8 parts by mass of a 10% by mass aqueous ammonium sulfate solution was added to the dispersion liquid containing the first aggregates, and 50 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Next, the temperature of the dispersion liquid containing the second aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 103 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 2 was obtained as above. The average particle diameter (50% D) of the finally obtained toner was 103 μm.

Example 3

A combination of 17.5 parts by mass of IRIODIN 153 (manufactured by MERCK KGAA: average particle diameter of the pigment of 51 μm) as a pearlescent pigment and 232.5 parts by mass of deionized water was put into a flask, and 0.3 part by mass of a 10% by mass aqueous ammonium sulfate solution was added thereto under stirring. Thereafter, while the resultant solution was being stirred, 0.8 parts by mass of the resin dispersion liquid was added to the upper portion of the surface of the solution under stirring, at a speed of 0.11 parts by mass/min by using the MASTERFLEX tube pump system (manufactured by YAMATO SCIENTIFIC CO. LTD.: inner diameter of tube of 0.8 mm).

Subsequently, 2 parts by mass of a 10% by mass aqueous ammonium sulfate solution was added thereto, and while the resultant solution was being stirred, 13 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the pearlescent pigment dispersion liquid, thereby obtaining a dispersion liquid containing first aggregates (first aggregation step).

Thereafter, 8 parts by mass of a 10% by mass aqueous ammonium sulfate solution was added to the dispersion liquid containing the first aggregates, and 50 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Next, the temperature of the dispersion liquid containing the second aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 71 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 3 was obtained as above. The average particle diameter (50% D) of the finally obtained toner was 71 μm.

Example 4

A combination of 3.5 parts by mass of IRIODIN 120 (manufactured by MERCK KGAA: average particle diameter of the pigment of 14 μm) as a pearlescent pigment and 46.5 parts by mass of deionized water was put into a flask, and 5 parts by mass of a 10% by mass aqueous ammonium sulfate solution was added thereto under stirring. Thereafter, while the resultant solution was being stirred, 40 parts by mass of the resin dispersion liquid was added to the upper portion of the surface of the solution under stirring, at a speed of 0.12 parts by mass/min by using the MASTERFLEX tube pump system (manufactured by YAMATO SCIENTIFIC CO. LTD.: inner diameter of tube of 0.8 mm).

Subsequently, 3 parts by mass of a 10% by mass aqueous ammonium sulfate solution was added thereto, and while the resultant solution was being stirred, 10 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the pearlescent pigment dispersion liquid, thereby obtaining a dispersion liquid containing first aggregates (first aggregation step).

Thereafter, 3 parts by mass of a 10% by mass aqueous ammonium sulfate solution was added to the dispersion liquid containing the first aggregates, and 20 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Subsequently, 0.5 parts by mass of a 10% by mass aqueous ammonium sulfate solution was added to the dispersion liquid containing the second aggregates, and 1 part by mass of the wax dispersion liquid was added thereto under stirring, at a speed of 0.11 parts by mass/min by using the MASTERFLEX tube pump system, thereby obtaining a dispersion liquid containing third aggregates.

Next, the temperature of the dispersion liquid containing the third aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 31 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 4 was obtained as above. The average particle diameter (50% D) of the finally obtained toner was 31 μm.

Example 5

A combination of 10.5 parts by mass of IRIODIN 111 (manufactured by MERCK KGAA: average particle diameter of the pigment of 9 μm) as a pearlescent pigment and 139.5 parts by mass of deionized water were put into a flask, and 2 parts by mass of a 10% by mass aqueous ammonium sulfate solution was added thereto under stirring. Thereafter, while the resultant solution was being stirred, 5 parts by mass of the resin dispersion liquid was added to the upper portion of the surface of the solution under stirring, at a speed of 0.12 parts by mass/min by using the MASTERFLEX tube pump system (manufactured by YAMATO SCIENTIFIC CO. LTD.: inner diameter of tube of 0.8 mm).

Subsequently, 3 parts by mass of a 10% by mass aqueous ammonium sulfate solution was added thereto, and while the resultant solution was being stirred, 13 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the pearlescent pigment dispersion liquid, thereby obtaining a dispersion liquid containing first aggregates (first aggregation step).

Thereafter, 8 parts by mass of a 10% by mass aqueous ammonium sulfate solution was added to the dispersion liquid containing the first aggregates, and 50 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Subsequently, 0.5 parts by mass of a 10% by mass aqueous ammonium sulfate solution was added to the dispersion liquid containing the second aggregates, and 1 part by mass of the wax dispersion liquid was added thereto under stirring, at a speed of 0.11 parts by mass/min by using the MASTERFLEX tube pump system, thereby obtaining a dispersion liquid containing third aggregates.

Next, the temperature of the dispersion liquid containing the third aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 13 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 5 was obtained as above. The average particle diameter (50% D) of the finally obtained toner was 13 rpm.

Example 6

A combination of 21 parts by mass of IRIODIN 323 (manufactured by MERCK KGAA: average particle diameter of the pigment of 15 μm) as a pearlescent pigment and 279 parts by mass of deionized water was put into a flask, and 1 part by mass of a 10% by mass aqueous ammonium sulfate solution was added thereto under stirring. Thereafter, while the resultant solution was being stirred, 3 parts by mass of the resin dispersion liquid was added to the upper portion of the surface of the solution under stirring, at a speed of 0.12 parts by mass/min by using the MASTERFLEX tube pump system (manufactured by YAMATO SCIENTIFIC CO. LTD.: inner diameter of tube of 0.8 mm).

Subsequently, 3 parts by mass of a 10% by mass aqueous ammonium sulfate solution was added thereto, and while the resultant solution was being stirred, 15 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the pearlescent pigment dispersion liquid, thereby obtaining a dispersion liquid containing first aggregates (first aggregation step).

Next, the temperature of the dispersion liquid containing the first aggregates was increased to 65° C. to cause fusion (fusion step). As a result of measuring the dispersion liquid obtained after the fusion by using SALD-7000 (manufactured by SHTMADZU Corporation), the average particle diameter (50% D) of the fused particles contained in the dispersion liquid was confirmed to be 18 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 6 was obtained as above. The average particle diameter (50% D) of the finally obtained toner was 18 μm.

Example 7

An amount of 150 parts by mass of the colorant dispersion liquid A was put into a flask, and 3 parts by mass of a 10% by mass aqueous ammonium sulfate solution was added thereto under stirring. Thereafter, while the resultant solution was being stirred, 23 parts by mass of the mixed solution A was added to the upper portion of the surface of the solution under stirring, at a speed of 0.12 parts by mass/min by using the MASTERFLEX tube pump system (manufactured by YAMATO SCIENTIFIC CO. LTD.: inner diameter of tube of 0.8 mm). In this manner, the resin dispersion liquid and the wax dispersion liquid were added simultaneously to the colorant dispersion liquid A, thereby obtaining a dispersion liquid containing first aggregates (first aggregation step).

Subsequently, 3 parts by mass of a 10% by mass aqueous ammonium sulfate solution was added to the dispersion liquid containing the first aggregates, and while the resultant solution was being stirred, 13 parts by mass of the wax dispersion liquid was added to the upper portion of the surface of the solution under stirring, at a speed of 0.11 parts by mass/min by using the MASTERFLEX tube pump system.

Thereafter, 15 parts by mass of a 10% by mass aqueous ammonium sulfate solution was added thereto, and 90 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Next, the temperature of the dispersion liquid containing the second aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 143 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 7 was obtained as above. The average particle diameter (50% D) of the finally obtained toner was 143 μm.

Example 8

A combination of 10.5 parts by mass of IRIODIN 120 (manufactured by MERCK KGAA: average particle diameter of the pigment of 14 μm) as a pearlescent pigment and 139.5 parts by mass of deionized water was put into a flask, and 6 parts by mass of a 10% by mass aqueous ammonium sulfate solution was added thereto under stirring. Thereafter, while the resultant solution was being stirred, 40 parts by mass of the mixed solution A was added to the upper portion of the surface of the solution under stirring, at a speed of 0.11 parts by mass/min by using the MASTERFLEX tube pump system (manufactured by YAMATO SCIENTIFIC CO. LTD.: inner diameter of tube of 0.8 mm). In this manner, the resin dispersion liquid and the wax dispersion liquid were added simultaneously to the pearlescent pigment dispersion liquid, thereby obtaining a dispersion liquid containing first aggregates (first aggregation step).

Thereafter, 15 parts by mass of a 10% by mass aqueous ammonium sulfate solution was added to the dispersion liquid containing the first aggregates, and 90 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Subsequently, 0.5 parts by mass of a 10% by mass aqueous ammonium sulfate solution was added to the dispersion liquid containing the second aggregates, and 0.5 parts by mass of the wax dispersion liquid was added thereto under stirring, at a speed of 0.11 parts by mass/min by using the MASTERFLEX tube pump system, thereby obtaining a dispersion liquid containing third aggregates.

Next, the temperature of the dispersion liquid containing the third aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 25 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 8 was obtained as above. The average particle diameter (50% D) of the finally obtained toner was 25 μm.

Example 9

An amount of 150 parts by mass of the colorant dispersion liquid A was put into a flask, and 0.3 parts by mass of a 10% by mass aqueous ammonium sulfate solution was added thereto under stirring. Thereafter, while the resultant solution was being stirred, 0.26 parts by mass of the resin dispersion liquid was added to the upper portion of the surface of the solution under stirring, at a speed of 0.11 parts by mass/min by using the MASTERFLEX tube pump system (manufactured by YAMATO SCIENTIFIC CO., LTD.: inner diameter of tube of 0.8 mm).

Subsequently, 3 parts by mass of a 10% by mass aqueous ammonium sulfate solution was added thereto, and while the resultant solution was being stirred, 10 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the colorant dispersion liquid A, thereby obtaining a dispersion liquid containing first aggregates (first aggregation step).

Thereafter, 10 parts by mass of a 10% by mass aqueous ammonium sulfate solution was added to the dispersion liquid containing the first aggregates, and 65 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Next, the temperature of the dispersion liquid containing the second aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 122 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 9 was obtained as above. The average particle diameter (50% D) of the finally obtained toner was 122 μm.

Example 10

An amount of 150 parts by mass of the colorant dispersion liquid A was put into a flask, and 0.3 parts by mass of a 10% by mass aqueous ammonium sulfate solution was added thereto under stirring. Thereafter, while the resultant solution was being stirred, 0.26 parts by mass of the resin dispersion liquid was added to the upper portion of the surface of the solution under stirring, at a speed of 0.11 parts by mass/min by using the MASTERFLEX tube pump system (manufactured by YAMATO SCIENTIFIC CO., LTD.: inner diameter of tube of 0.8 mm).

Subsequently, 3 parts by mass of a 10% by mass aqueous ammonium sulfate solution was added thereto, and while the resultant solution was being stirred, 10 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the colorant dispersion liquid A, thereby obtaining a dispersion liquid containing first aggregates (first aggregation step).

Thereafter, 10 parts by mass of a 10% by mass aqueous ammonium sulfate solution was added to the dispersion liquid containing the first aggregates, and 65 parts by mass of the resin dispersion liquid was added thereto under stirring, at a speed of 0.11 parts by mass/min by using the MASTERFLEX tube pump system, thereby obtaining a dispersion liquid containing second aggregates (second aggregation step).

Subsequently, 1 part by mass of a 10% by mass aqueous ammonium sulfate solution was added to the dispersion liquid containing the second aggregates, and while the resultant solution was being stirred, 1.5 parts by mass of the wax dispersion liquid was added to the upper portion of the surface of the solution under stirring, at a speed of 0.11 parts by mass/min by using the MASTERFLEX tube pump system, thereby obtaining a dispersion liquid containing third aggregates.

Next, the temperature of the dispersion liquid containing the third aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 160 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 10 was obtained as above. The average particle diameter (50% D) of the finally obtained toner was 160 μm.

Example 11

A combination of 7 parts by mass of IRIODIN 153 (manufactured by MERCK KGAA: average particle diameter of the pigment of 51 μm) as a pearlescent pigment and 93 parts by mass of deionized water was put into a flask, and 8 parts by mass of a 10% by mass aqueous ammonium sulfate solution was added thereto under stirring. Thereafter, while the resultant solution was being stirred, 13 parts by mass of the resin dispersion liquid was added to the upper portion of the surface of the solution under stirring, at a speed of 0.11 parts by mass/min by using the MASTERFLEX tube pump system (manufactured by YAMATO SCIENTIFIC CO. LTD.: inner diameter of tube of 0.8 mm).

Subsequently, 2 parts by mass of a 10% by mass aqueous ammonium sulfate solution was added thereto, and while the resultant solution was being stirred, 3 parts by mass of the wax dispersion liquid was added to the upper portion of the surface of the solution under stirring, at a speed of 0.11 parts by mass/min by using the MASTERFLEX tube pump system. In this manner, the resin dispersion liquid and the wax dispersion liquid were added in this order to the pearlescent pigment dispersion liquid, thereby obtaining a dispersion liquid containing first aggregates (first aggregation step).

Next, the temperature of the dispersion liquid containing the first aggregates was increased to 65° C. to cause fusion (fusion step). As a result of measuring the dispersion liquid obtained after the fusion by using SALD-7000 (manufactured by SHIMADZU Corporation), the average particle diameter (50% D) of the fused particles contained in the dispersion liquid was confirmed to be 83 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Example 11 was obtained as above. The average particle diameter (50% D) of the finally obtained toner was 83 μm.

Example 12

Hereinafter, the process of preparing a colorant dispersion liquid B will be described.

A colorant dispersion liquid B was obtained by the same method as being used for preparing the colorant dispersion liquid A, except that the rotation frequency of the CLEARMIX was changed to 1,500 rpm. As a result of measuring the colorant dispersion liquid B by using SALD-7000 (manufactured by SHIMADZU Corporation), the average particle diameter (50% D) of the pigment particles was confirmed to be 6 μm.

Hereinafter, the operation from the aggregation step to the external addition step will be described.

A toner of Example 12 was obtained by performing the operation from the aggregation step to the external addition step in the same manner as in Example 2, except that the colorant dispersion liquid B was used instead of the colorant dispersion liquid A.

As a result of measuring the dispersion liquid obtained after fusion by using SALD-7000 (manufactured by SHIMADZU Corporation), the average particle diameter (50% D) of the fused particles contained in the dispersion liquid was confirmed to be 9 μm. Moreover, the average particle diameter (50% D) of the toner finally obtained after the external addition step was 9 μm.

Example 13

A toner of Example 13 was obtained by performing the operation from the aggregation step to the external addition step in the same manner as in Example 2, except that 7 parts by mass of IRIODIN 153 (manufactured by MERCK KGAA: average particle diameter of the pigment of 51 μm) as a pearlescent pigment and 93 parts by mass of deionized water were put into a flask instead of the colorant dispersion liquid A.

As a result of measuring the dispersion liquid obtained after fusion by using SALD-7000 (manufactured by SHIMADZU Corporation), the average particle diameter (50% D) of the fused particles contained in the dispersion liquid was confirmed to be 80 μm. Moreover, the average particle diameter (50% D) of the toner finally obtained after the external addition step was 80 μm.

Comparative Example 1

A combination of 300 parts by mass of the colorant dispersion liquid A, 53 parts by mass of the resin dispersion liquid, and 15 parts by mass of the wax dispersion liquid was simultaneously put into a flask, and 15 parts by mass of a 10% by mass aqueous ammonium sulfate solution was added thereto under stirring. Thereby, a dispersion liquid containing aggregates consisting of the colorant particles, the resin, and the wax was obtained.

Thereafter, the temperature of the dispersion liquid was increased to 65° C. to cause fusion. As a result of measuring the dispersion liquid obtained after the fusion by using SALD-7000 (manufactured by SHIMADZU Corporation), the average particle diameter (50% D) of the fused particles contained in the dispersion liquid was confirmed to be 120 μm.

Thereafter, the dispersion liquid obtained after the fusion was repeatedly filtered and washed with deionized water (washing step).

Subsequently, the fused particles separated by the final filtration were dried by a vacuum drier, thereby obtaining a dry toner (drying step).

Next, 2 parts by mass of hydrophobic silica and 0.5 parts by mass of titanium oxide were added to the dry toner, and the resultant was mixed by a HENSCHEL mixer (external addition step).

A toner of Comparative Example 1 was obtained as above. The average particle diameter (50% D) of the finally obtained toner was 120 μm.

Comparative Example 2

Hereinafter, the process of preparing a colorant dispersion liquid C will be described.

A colorant dispersion liquid C was obtained by the same method as being used for preparing the colorant dispersion liquid A, except that the rotation frequency of the CLEARMIX was changed to 2,000 rpm. As a result of measuring the colorant dispersion liquid C by using SALD-7000 (manufactured by SHIMADZU Corporation), the average particle diameter (50% D) of the colorant particles was confirmed to be 4 μm.

A toner of Comparative Example 2 was obtained by performing the operation from the aggregation step to the external addition step in the same manner as in Example 2, except that the colorant dispersion liquid C was used instead of the colorant dispersion liquid A.

As a result of measuring the dispersion liquid obtained after fusion by using SALD-7000 (manufactured by SHIMADZU Corporation), the average particle diameter (50% D) of the fused particles contained in the dispersion liquid was confirmed to be 7 μm. Moreover, the average particle diameter (50% D) of the toner finally obtained after the external addition step was 7 μm.

Comparative Example 3

A combination of 30 parts by mass of IRIODIN 120 (manufactured by MERCK KGAA: average particle diameter of the pigment of 14 μm) as a pearlescent pigment, 60 parts by mass of a polyester resin, and 10 parts by mass of ester wax was put into a HENSCHEL mixer and mixed together. Thereafter, the mixture was melted and kneaded with a twin-screw kneader at 120° C., thereby obtaining a kneaded material. The obtained kneaded material was coarsely ground with a feather mill and then further ground with a jet mill. Subsequently, the resultant was classified by a rotor-type classifier, thereby obtaining toner base particles having a average particle diameter of 15 μm.

Next, 2 parts by mass of hydrophobic silica and 0.5 parts by mass of titanium oxide were added to the toner base particles, and the resultant was mixed with a HENSCHEL mixer.

A toner of Comparative Example 3 was obtained as above. The average particle diameter (50% D) of the finally obtained toner was 15 μm.

FIG. 4 illustrates the composition of the toner produced in each example.

FIG. 5 illustrates the evaluation results obtained from the toners of Examples 1 to 13 and Comparative Examples 1 to 3.

In Comparative Example 1 in which the colorant dispersion liquid, the resin dispersion liquid, and the wax dispersion liquid were added simultaneously, image quality was insufficient, and the evaluation results were poor in both the fogging and filming.

In Comparative Example 2 in which a colorant having a average particle diameter of less than 6 μm was used, image quality was poor.

In Comparative Example 3 in which a grinding method was used, the evaluation results were poor in all of the image quality, offset properties, fogging, and filming.

On the contrary, in Examples 1 to 13 to which the present embodiments were applied, sufficient image quality was obtained, fogging or offset did not easily occur, and the evaluation result of filming was excellent.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of producing an electrophotographic toner, comprising the steps of:

forming a colorant dispersion liquid that contains colorant particles having an average particle diameter of 6 μm or greater;

forming a first resin dispersion liquid that contains resin particles;

forming a first wax dispersion liquid that contains wax particles;

adding, in a first aggregation, the first resin dispersion liquid and the first wax dispersion liquid to the colorant dispersion liquid;

adding, in a second aggregation after the first aggregation, a second resin dispersion liquid that contains resin particles; and adding, in the second aggregation, a second wax dispersion liquid that contains wax particles, wherein the amount of the wax added in the second aggregation is 90% by mass or more of the total amount of the wax that is added.

2. The method according to claim 1, wherein the first resin dispersion liquid and the first wax dispersion liquid are simultaneously added to the colorant dispersion liquid in the first aggregation.

3. The method according to claim 1, wherein the first resin dispersion liquid is added to the colorant dispersion liquid before the first wax dispersion liquid is added to the colorant dispersion liquid.

4. The method according to claim 1, wherein the amount of the resin added in the first aggregation is 3 parts or more by mass per 100 parts by mass of a total amount of wax added during the method of producing the toner including during the first aggregation and the second aggregation.

5. The method according to claim 1, wherein the colorant particles include pearlescent pigment particles.

6. The method according to claim 1, wherein the colorant particles have an average particle diameter between 10 μm to 60 μm.

7. The method according to claim 6, wherein the toner which is produced is comprised of toner particles having an average particle diameter from 7 μm to 150 μm.

8. The method according to claim 7, wherein:

the content of colorant in the produced toner is between 15% by mass and 50% by mass of the combined mass of the colorant, resin and wax;

the content of resin in the produced toner is between 30% by mass to 90% by mass of the combined mass of the colorant, resin and wax; and the content of wax in the produced toner is between 5% by mass to 20% by mass of the combined mass of the colorant, resin and wax.

* * * * *